United States Patent [19]

Batchelor et al.

[11] Patent Number: 4,526,055

[45] Date of Patent: Jul. 2, 1985

[54] LOCKABLE CONTROL LEVER ARRANGEMENT

[75] Inventors: Frederick H. Batchelor, Stretford; David J. Brown, Kenilworth, both of England

[73] Assignee: Massey-Ferguson Services N.V., Curacao, Netherlands Antilles

[21] Appl. No.: 367,691

[22] Filed: Apr. 12, 1982

[30] Foreign Application Priority Data

Apr. 21, 1981 [GB] United Kingdom ..... 8112380

[51] Int. Cl.[3] ..... G05G 5/02; G05G 9/02; G05G 11/00

[52] U.S. Cl. ..... 74/471 XY; 74/483 R; 74/529; 180/271; 137/636.2; 251/114

[58] Field of Search ..... 74/471 XY, 480 R, 483 R, 74/529; 180/271; 137/636.2; 251/114

[56] References Cited

U.S. PATENT DOCUMENTS

| | | | |
|---|---|---|---|
| 1,938,796 | 12/1933 | Bernard | 74/476 |
| 2,588,565 | 3/1952 | Pealer | 74/483 X |
| 3,523,588 | 8/1970 | Bradshaw | 180/271 |
| 3,811,020 | 5/1974 | Johnson et al. | 180/271 X |
| 3,831,633 | 8/1974 | Comer | 74/471 XY X |
| 4,051,860 | 10/1977 | Dowd et al. | 137/636.2 X |
| 4,069,900 | 1/1978 | Stamate | 180/271 X |
| 4,222,287 | 9/1980 | Drone et al. | 74/529 |
| 4,301,834 | 11/1981 | Comer, Jr. et al. | 137/636.2 X |
| 4,358,965 | 11/1982 | Schroeder | 74/483 R X |

FOREIGN PATENT DOCUMENTS

| | | |
|---|---|---|
| 1599295 | 7/1970 | France . |
| 323553 | 1/1930 | United Kingdom . |
| 719381 | 12/1954 | United Kingdom . |
| 722201 | 1/1955 | United Kingdom . |
| 796693 | 6/1958 | United Kingdom . |

*Primary Examiner*—Allan D. Herrmann
*Attorney, Agent, or Firm*—Robert L. Farris

[57] ABSTRACT

A lockable control lever arrangement in which a pivotally mounted control lever (10) is provided with linkages (12,13,16,17,18,19) for connecting the control lever with one or more functions to be controlled. A locking device (60) is provided for locking the lever in a given position.

The locking device includes a first locking formation (23,24) operatively connected with each of the linkages, a locking member (20,21,22) having a second locking formation (**21*a*,22*a*) engageable with the first locking formation to lock the control lever (10) in the given position, and a manually operable operating means (26,27,28,29**) for moving the locking member to bring the first and second formations into engagement to lock the control lever.

The control lever arrangement is particularly applicable to the operation of hydraulic valves which control the loaders and diggers of industrial tractors.

1 Claim, 5 Drawing Figures

LOCKABLE CONTROL LEVER ARRANGEMENT

TECHNICAL FIELD

This invention relates to control lever arrangements and particularly, though not exclusively, to such arrangements for the control of hydraulic valves on industrial or agricultural tractors and the like.

DISCLOSURE OF THE INVENTION

It is an object of the present invention to provide an improved form of control lever arrangement which includes a safeguard against accidental use.

Thus according to the present invention there is provided a lockable control lever arrangement comprising a pivotally mounted control lever, linkage means for connecting the control lever with a function to be controlled, and a locking device for locking the lever in a given position, the arrangement being characterised in that the locking device comprises a first locking formation operatively connected with the linkage means, a locking member having a second locking formation engageable with the first locking formation to lock the control lever in said given position, and a manually operable operating means for moving the locking member to bring the first and second formations into engagement to effect said locking.

The present invention is particularly applicable to control lever arrangements for the control of one or more hydraulic valves. For example, control lever arrangements employed to operate the hydraulic valves which control loaders and diggers of industrial tractors. When used in such an application the locking device may be arranged to lock the or each associated control valve in its neutral position thus preventing operation of the loader or digger. As will be appreciated this is a safety device to prevent accidental operation of the loader and digger and if associated with, for example, a key operated lock, could also be used as a security device to prevent unauthorised use of the loader or digger.

In a preferred construction part of the linkage means moves in a first direction and the locking member pivots in a plane generally perpendicular to said first direction about an axis generally parallel to said first direction to engage the first locking formation carried by said part of the linkage means.

Conveniently the first locking formation may comprise a disc mounted on said part of the linkage means and the second locking formation may comprise an arm with a cut-out shaped to receive part of the outer peripheral portion of the disc to prevent movement of said part of the linkage means in said first direction when the arm is pivotted about said generally parallel axis into engagement with the disc.

The control lever may be pivotable about two perpendicular axes to control two functions via separate linkage means in, for example, the manner described in U.S. Pat. No. 4,389,151. In such an arrangement each linkage means would be provided with a first locking formation and the locking member would be provided with two second locking formations for engagement with said respective first locking formations.

Preferably the or each linkage means includes a generally vertically movable operating member which carries the first locking formation and the locking member pivots in a generally horizontal plane to engage the or each first locking formation.

Preferably the control lever is supported on a generally vertically extending stand, part of the stand carrying the locking member for pivotal movement in a generally horizontal plane.

The control lever arrangement may include a second pivotally mounted control lever which is also provided with a further locking device having first and second interengageable locking formations, said further locking device also being operated by said manually operable operating means.

The present invention also provides a loader or digger controlled by a number of fluid pressure control valves operated by a lockable control lever arrangement of the form described above.

DESCRIPTION OF DRAWINGS

Two embodiments of the present invention will now be described, by way of example only, with reference to the accompanying drawings in which.

BEST MODE OF CARRYING OUT INVENTION

Figure 1:
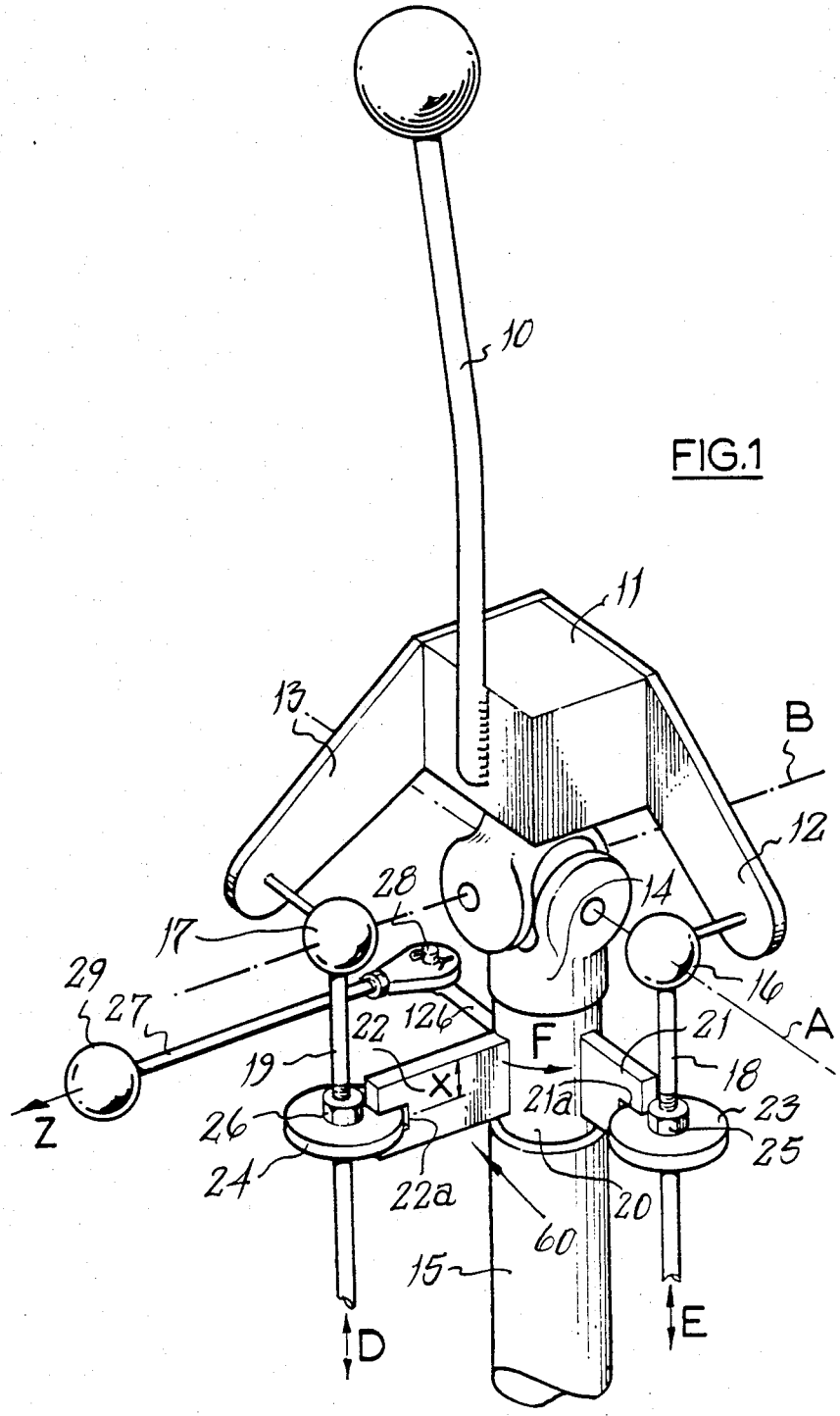
FIG. 1 is a diagrammatic perspective view of a single control lever arrangement embodying the present invention.

FIG. 1 shows a control lever arrangement in which a lever 10 is welded to a block 11 which supports two arms 12 and 13. The block is supported via a universal joint 14 on a stand 15.

The universal joint 14 permits pivotting of the lever 10 about a first axis A and about a second intersecting axis B at right angles thereto. The arms 12 and 13 are connected via ball joints 16 and 17 respectively with valve operating rods 18 and 19. Ball joint 16 lies on axis A while ball joint 17 lies on axis B.

As will be appreciated pivotting of lever 10 about axis A causes rod 19 to move vertically as indicated by arrow D to operate an associate control valve spool. No movement of rod 18 occurs during simple pivotting of lever 10 about axle A since ball joint 16 lies on axis A. In a similar manner pivotting of lever 10 about axis B moves rod 18 and the associated valve spool, as indicated by arrow E, without movement of rod 19 since ball joint 17 lies on axis B. Valve rods 18 and 19 can be moved simultaneously by pivotting lever 10 about a diagonal axis lying between axis A and B.

A locking device (60) is provided for the control lever. The locking device comprises a locking member in the form of a collar 20 which is pivotally mounted on stand 15 and has two arms 21 and 22 each having locking formations in the form of 21*a*,22*a*. The locking device also includes further locking formations in the form of discs 23 and 24 which are engageable by cut-outs 21*a*,22*a* and are mounted on valve rods 18 and 19 by nuts 25 and 26, which engage screw-threaded portions of the rods. Washers may conveniently be used to provide discs 23 and 24.

It will be appreciated that when the locking device is engaged (has shown in FIG. 1) the cut-outs 21*a* and 22*a* engage the discs 23 and 24 and vertical movement of the control rods 18 and 19 is prevented so that the valve spools assocated with these control rods are locked against movement.

In the arrangement illustrated in FIG. 1 the valves controlled by lever 10 are both biassed to their neutral (closed) position so that when the lever 10 is released it returns to its upright neutral position. The cut-outs 21*a* and 22*a* are arranged to only be engageable with discs 23 and 24 when the lever is in its neutral position.

As an additional safety feature the half-depth X of each are 21,22 can be arranged to be greater than the travel of each rod from its neutral position so that each disc 23,24 cannot move to a location above or below the associated arm so that the control lever and associated valves can only be locked in their neutral postions.

An operating means for the locking member 20,21,22 is shown diagrammatically in FIG. 1 in the form of an arm 26 which is welded to the sleeve 20 and a push-pull rod 27 which is pivotted to the arm 26 at 28. Thus the locking member can be moved from the locked position shown in FIG. 1 by pulling handle 29 associated with rod 27 in the direction of the arrow Z of FIG. 1. This movement of handle 29 rotates the sleeve 20 and the arms 21 and 22 in the direction of arrow F through an angle of approximately 45° thus disenganging the discs 23 and 24 and allowing the control lever 10 to be moved. The control lever is locked by reversing the above movement of handle 29 to re-engage the cut-outs 21*a* and 22*a* with the discs 23 and 24 respectively.

If the control lever 10 is used to control, for example, a front loader on an industrial tractor, rod 18 could be used to operate a hydraulic valve which controls the rolling-back and emptying of the loader bucket while rod 19 could be used to operate a hydraulic valve which control the raising and lowering of the loader beams.

Figure 2:
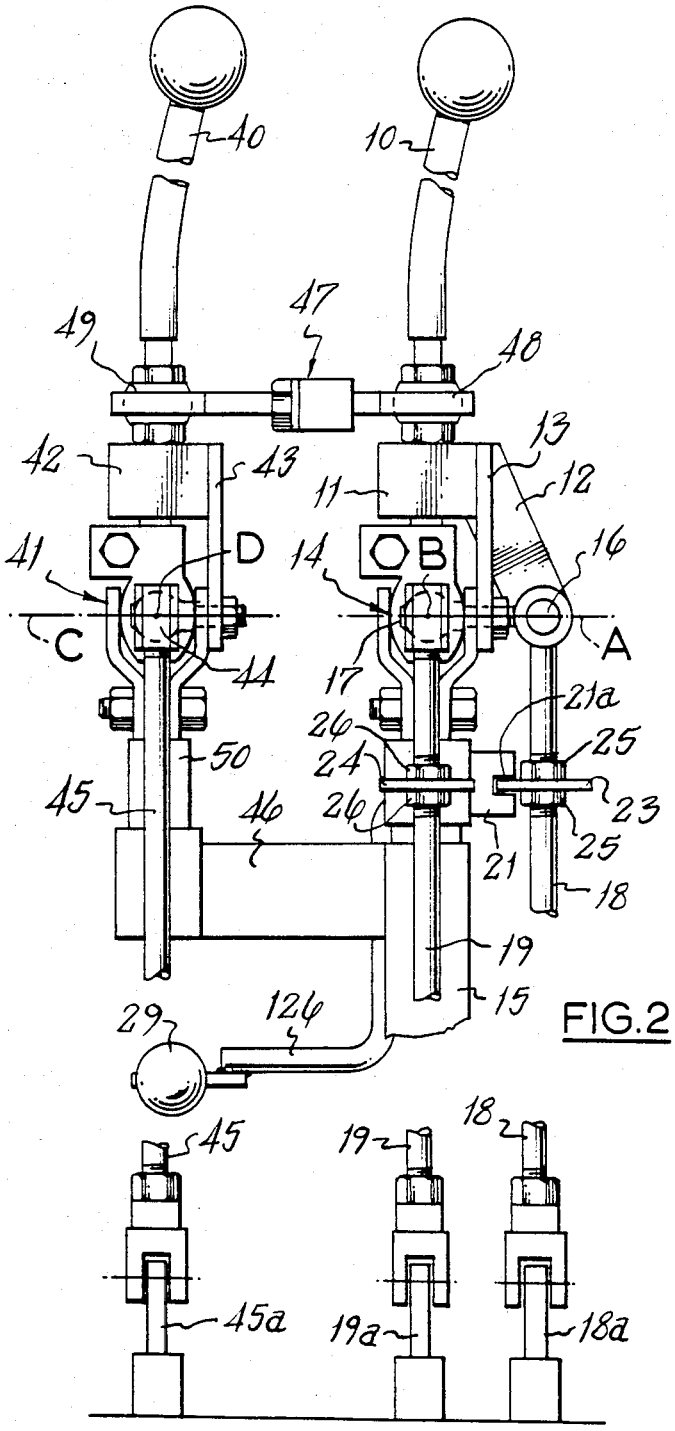
FIG. 2 is a side view of a twin control lever arrangement embodying the present invention.

FIG. 2 shows a twin lever control arrangement of the form shown in FIG. 1 of the applicants previously referred to U.S. Pat No. 4,389,151 modified to include a locking device in accordance with the present invention. The construction and arrangement of the control lever 10 shown in FIG. 2 is generally the same as that previously described in relation to FIG. 1 and corresponding elements have therefore been similarly numbered.

A second control lever 40 is provided which is mounted on a universal joint 41 for pivotting about an axis C (which is co-axial with axis A) and an axis D (which is parallel to axis B). Lever 40 is carried by a block 42 which in turn carries an arm 43. Arm 43 is connected via ball joint 44 with a vlave operating rod 45. When the twin control lever arrangement is used on a loader this valve operating rod controls a valve which opens and closes a 4 in 1 bucket of the loader.

FIG. 2 diagrammatically illustrates a block 70 of spool valves whose spools 18*a*,19*a* and 45*a* are connected to control rods 18,19 and 45 respectively.

As can be seen the ball joint 41 is mounted on an arm 46 which is attached to the stand 15. The two control levers 10 and 40 are inter-connected via a link 47 which is pivotally connected via ball joints 48 and 49 with the two levers 10 and 40.

As will be appreciated pivotting of lever 10 about axis B operates control rod 18 without operating control rods 19 and 45, although lever 40 will also pivot about axis D due to the presence of the connecting link 47. Pivotting of lever 10 about axis A causes operation of control rod 19 without operation of control rods 18 and 45.

Pivotting of control lever 40 about axis C causes operation of control rod 45 without operation of control rods 18 and 19, and pivotting of control lever 40 about axis D causes operation of control rod 18 via link 47 without operation of control rods 19 and 45.

If the reader requires further description of the operation and construction of control levers 10 and 40 reference should be made to the applicant's previously referred to U.S. Pat. No. 4,389,151.

Figure 3:
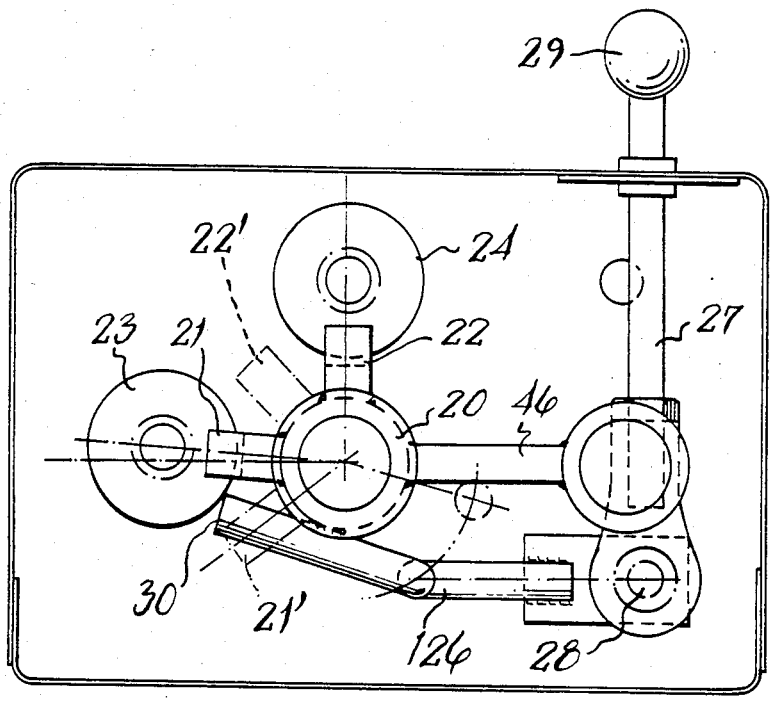
FIGS. 3 and 4 are plan and side views respectively of parts of FIG. 2 on a larger scale.
Figure 4:
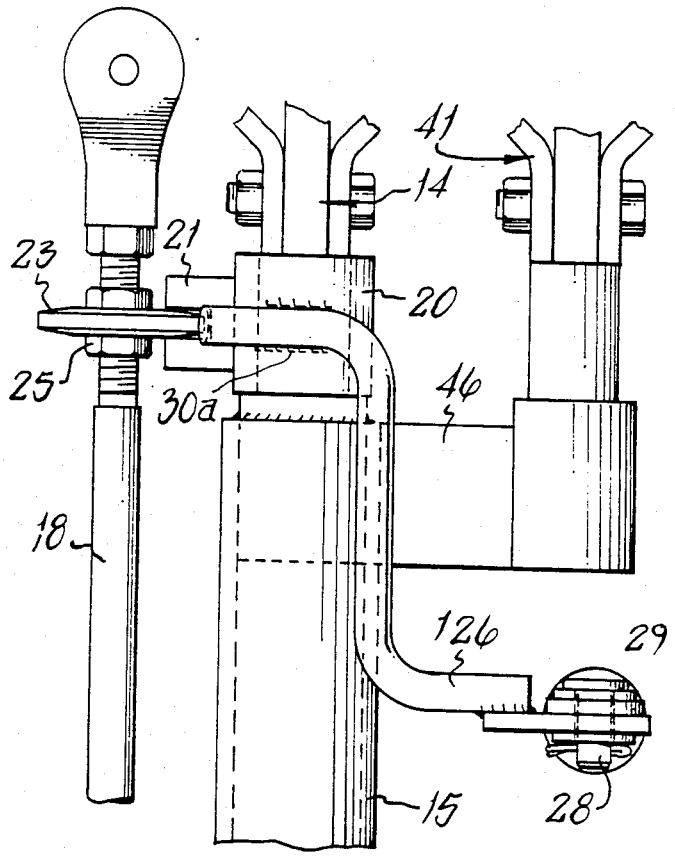

FIGS. 3 and 4 show parts of the control lever arrangement of FIG. 2 on a larger scale. As can be seen the collar 20 is moved by an arm 26 which is of Z-shape. Also the end 30 of rod 26 which is welded to collar 20 at 30*a* is arranged to abutt disc 23 when the control lever 10 is locked thus providing and end stop for the movement of the rod 27. The unlocked positions of arms 21 and 22 are shown in dotted detail at 21' and 22' in FIG. 3. FIG. 3 also shows a sheet metal casing which surrounds the lower portion of the control lever arrangement below the universal joints.

In FIG. 2 no locking device is shown for operation on control lever 40. However, if desired a collar similar to the collar 20 used on control lever 10 could be mounted around the reduced diameter portion 50 provided below the universal joint 41. As will be appreciated if a collar is mounted on portion 50 it will only require one arm equivalent to the arm 22 for engagement with a washer mounted on control rod 45. This second collar could be arranged to be operated from the same control handle 29, either by a separate connection with the handle or by connecting the second collar with the first collar so that pivotting of the first collar results in pivotting of the second collar.

Although in the arrangements described above the control levers are spring biassed to their neutral positions so that the discs 23,24 etc. automatically come into registry with the cut-outs 21*a*,22*a* etc. when the levers are released it is possible to shape the arms 21 and 22 so they automatically cam the discs into registry with the cut-outs 21*a* and 22*a* if spring loading to their neutral positions is not employed.

Figure 5:
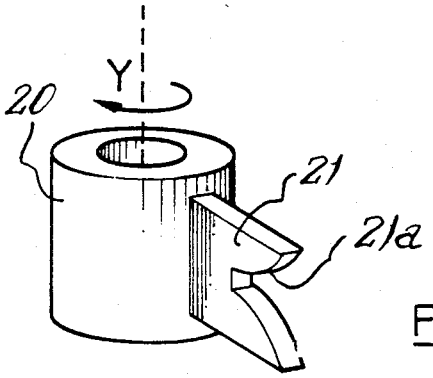
FIG. 5 shows part of a modified form of locking device which includes a cam action.

For example, FIG. 5 diagrammatically illustrates a shaped arm 21 which on pivotting in the direction of the arrow Y of FIG. 5 will automatically cam any associated disc into its cut-out 21*a*.

The present invention thus provides a simple and yet efficient lockable control lever arrangement which is particularly suitable for the control of one or more hydraulic valves used to control, for example, loaders and diggers of industrial tractors.

We claim:

1. A lockable control lever arrangement for the control of first and second hydraulic valves which each have a neutral position in which the operation of an associated function is prevented, the arrangement comprising a control lever mounted on a generally vertically extending stand for pivotting about two perpendicular axles to operate said valves; first and second generally vertically extending operating members respectively forming part of first and second linkage means for connecting the control lever with the first and second valves respectively; and a locking device comprising first and second locking formations mounted on the first and second operating members respectively, a locking member which encircles a portion of the stand for pivotal movement about the stand in a generally horizontal plane, said locking member having first and second arms each with a cut out shaped to receive part of the first and second locking formations respectively when the associated valves are in their neutral positions and a manually operable operating means connected with the locking member for pivotting the locking member between an unlocked position in which both linkage means are free to move and locked position in which both cut outs receive their associated locking formation to prevent movement of the associated linkage means and hence lock the control lever and the associated valves in their neutral positions.

* * * * *